US010943568B2

(12) United States Patent
Scott

(10) Patent No.: US 10,943,568 B2
(45) Date of Patent: Mar. 9, 2021

(54) MUSIC INSTRUMENT, METHOD OF MAKING AND USING THE SAME

(71) Applicant: Andrew Justin Scott, Colorado Springs, CO (US)

(72) Inventor: Andrew Justin Scott, Colorado Springs, CO (US)

( * ) Notice: Subject to any disclaimer, the term of this patent is extended or adjusted under 35 U.S.C. 154(b) by 0 days.

(21) Appl. No.: 16/825,702

(22) Filed: Mar. 20, 2020

(65) Prior Publication Data

US 2020/0302900 A1 Sep. 24, 2020

Related U.S. Application Data

(60) Provisional application No. 62/821,253, filed on Mar. 20, 2019.

(51) Int. Cl.
*G10D 3/14* (2020.01)
*G10H 3/18* (2006.01)

(52) U.S. Cl.
CPC ..... *G10D 3/14* (2013.01); *G10H 3/18* (2013.01)

(58) Field of Classification Search
CPC ..... G10D 3/14; G10H 3/18
See application file for complete search history.

(56) References Cited

U.S. PATENT DOCUMENTS

| | | | |
|---|---|---|---|
| 2,968,204 | A | 1/1961 | Fender |
| 3,302,507 | A | 2/1967 | Fender |
| 3,398,623 | A | 8/1968 | Smith |
| 4,320,685 | A | 3/1982 | Pytlewski |
| 9,478,198 | B1 | 10/2016 | Daley |

*Primary Examiner* — Kimberly R Lockett
(74) *Attorney, Agent, or Firm* — Aspire IP, LLC; Scott J. Hawranek

(57) ABSTRACT

A musical instrument, method of making and using the same, where the musical instrument can play one or more notes within a range of more than one octave on a single string without a fret or fretboard.

15 Claims, 16 Drawing Sheets

MUSIC INSTRUMENT, METHOD OF MAKING AND USING THE SAME

CROSS-REFERENCE TO RELATED APPLICATIONS

The present application claims the benefit of and priority, under 35 U.S.C. § 119(e), to U.S. Provisional Patent Application No. 62/821,253 filed Mar. 20, 2019, which is incorporated herein by reference in its entirety.

BACKGROUND OF THE INVENTION

Field of the Invention

The present invention generally relates to a music instrument, method of making and using the same and more particularly to a musical instrument that a user can play one or more notes within range of over an octave per string.

SUMMARY OF THE INVENTION

Accordingly, the invention is directed to a musical instrument, method of making and using the same that substantially obviates one or more of the problems due to limitations and disadvantages of the related art.

Another advantage of the invention is to provide a musical instrument that allows a user to play one full octave or greater without any adjustment of the instrument on a single string other than moving the string.

Another advantage of the invention is to provide a musical instrument that is easy to play.

Another advantage of the invention is to provide a musical instrument that can be played acoustic, amplified or some combination.

Yet still another advantage of the invention is to provide a musical instrument that does not include a fret board.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the musical instrument includes a body having a top, a bottom, a first side, an opposite second side and a thickness between the first side and the second side. The instrument includes a neck having a first end, a second end, a first side and an opposite second side. The neck does not include a fingerboard, a fret or a fret region and is not played by pressing the string into making contact with the neck. The first end of the neck includes a head either configured integral with the neck as a single unit piece of material or coupled to the first end of the neck. The head includes one or more tuning pegs configured to receive one or more guitar strings. The instrument also includes one or more guitar strings where each guitar string has a first end and second opposite end. The first end of each guitar string is configured to be attached to the one or more tuning pegs. The bridge assembly is releasably coupled to a bottom portion of the body configured to receive the second end of each guitar string. Optionally, the bridge assembly can be permanently attached to the body, or even made out of holes through the body in some variations of the instrument, depending on design modifications. The instrument further includes one or more stop block units releasably coupled to the body between the bridge assembly and the neck. Each of the one or more stop block units includes a channel region configured to receive a rotational unit having a channel region and a ball bearing to permit easy rotation. The channel region of the rotational unit is configured to receive at least a portion of each guitar string. In operation, each guitar string is stretched between the bridge assembly to the tuning peg and over the rotational unit such that a portion of the guitar string can move from a first position to a second position on application of force and there is a distance between each guitar string at the first of the neck to allow a user to tension each string to play one or more notes within a range of over an octave per string. Optionally, one or more electrical pickups coupled to a portion of the body.

In another aspect of the present invention, a method of playing a musical instrument includes providing an instrument described herein and placing a finger on one of the plurality of strings and when playing a user can play one or more notes within range of over an octave per string.

This Summary section is neither intended to be, nor should be, construed as being representative of the full extent and scope of the present disclosure. Additional benefits, features and embodiments of the present disclosure are set forth in the attached figures and in the description hereinbelow, and as described by the claims. Accordingly, it should be understood that this Summary section may not contain all of the aspects and embodiments claimed herein.

Additionally, the disclosure herein is not meant to be limiting or restrictive in any manner. Moreover, the present disclosure is intended to provide an understanding to those of ordinary skill in the art of one or more representative embodiments supporting the claims. Thus, it is important that the claims be regarded as having a scope including constructions of various features of the present disclosure insofar as they do not depart from the scope of the methods and apparatuses consistent with the present disclosure (including the originally filed claims). Moreover, the present disclosure is intended to encompass and include obvious improvements and modifications of the present disclosure.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1:
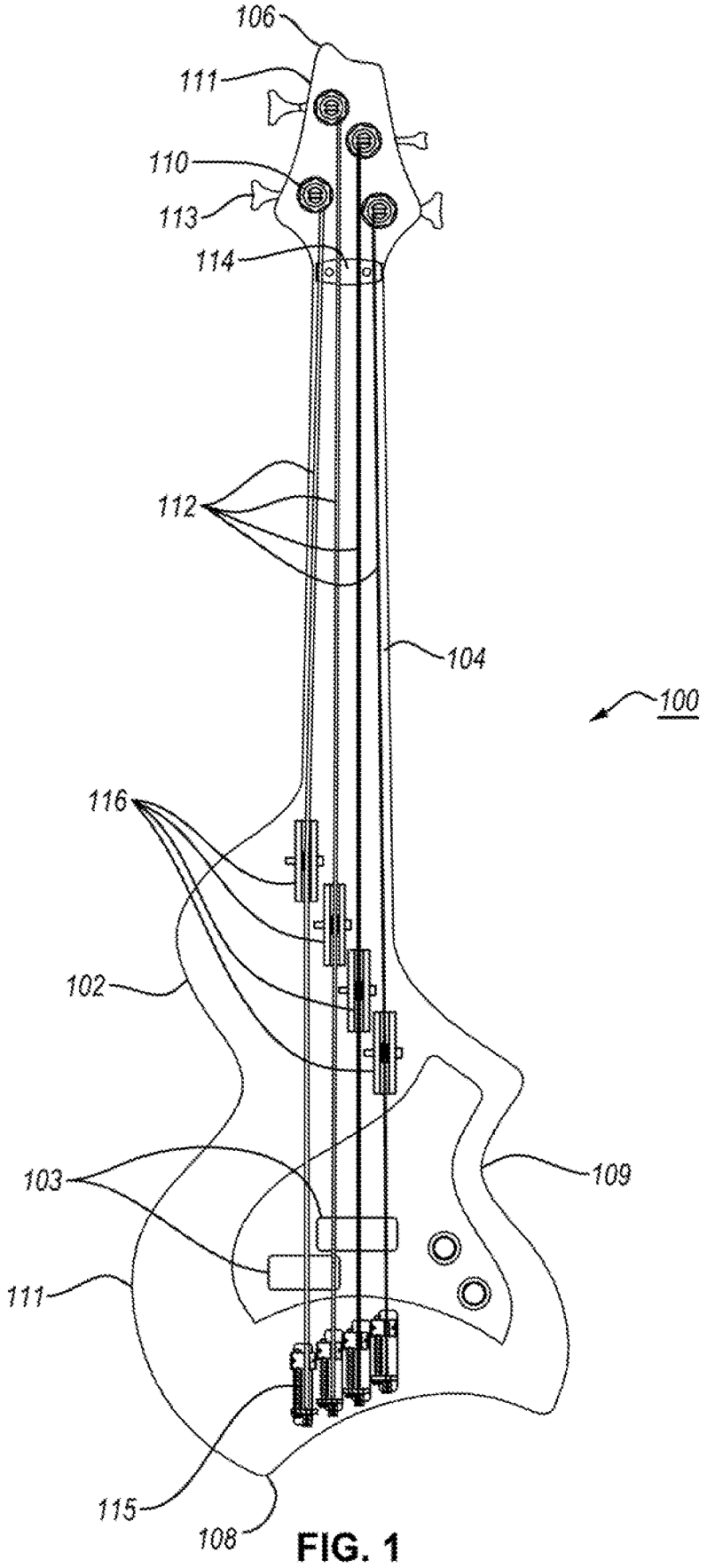
FIG. 1 illustrates an exemplary view of a musical instrument according to an embodiment of the invention.

The following detailed description describes a music instrument, method of making and using the same, and is presented to enable any person skilled in the art to make and use the disclosed subject matter in the context of one or more particular implementations. Various modifications, alterations, and permutations of the disclosed implementations can be made and will be readily apparent to those skilled in the art, and the general principles defined may be applied to other implementations and applications, without departing from scope of the disclosure. The present disclosure is not intended to be limited to the described or illustrated implementations, but to be accorded the widest scope consistent with the described principles and features.

In order to more fully appreciate the present disclosure and to provide additional related features, the following references are incorporated therein by reference in their entirety:

(1) U.S. Pat. No. 2,968,204, which discloses an invention that relates to an electrical musical instrument of the lute type, and more particularly to an electromagnetic pickup means therefor. The invention is particularly applicable to an electric guitar or similar musical instrument in which vibration of stretched strings is affected by plucking or picking the same.

(2) U.S. Pat. No. 3,302,507, which discloses an acoustic guitar, which comprises a hollow wooden body having top and bottom sound boards generally parallel to each other, a neck, means to connect said neck to said body, neck-truss means mounted longitudinally is said neck, said neck-truss means being adjustable to vary the curvature of said neck, body-truss means mounted in said body in general alignment with said neck-truss means, said body-truss means being adjustable independently of said neck-truss means to vary the forces in said top sound board, means to operably associate with each other the adjacent end portions of said neck-truss means and body-truss means, and a plurality of guitar strings mounted in tensioned relationship over said neck and over said top sound board and connected thereto.

(3) U.S. Pat. No. 3,398,623, which discloses a guitar having a body and a neck, the neck comprising part of an integral stem which carries the string anchor, inclined bridge and inclined nut over which the strings are tensioned in a common plane.

(4) U.S. Pat. No. 4,320,685, which discloses a guitar having a split level top of its sound box which thus is formed at two different (vertically separated) levels and connected by an angular cross bridge to which one end of the strings is anchored so as to directly vibrate the chamber. The result is an increased sound volume and resonance persistence which is achieved without the distortion that may result from electronic amplification when applied to conventional guitars or other stringed musical instruments.

(5) U.S. Pat. No. 9,478,198, which discloses a musical instrument having a plurality of strings is provided, the strings extending along a longitudinal dimension. The instrument includes a concave fingerboard extending along the longitudinal dimension and spaced from the plurality of strings to define the action, wherein a portion of the concave fingerboard is below an adjacent surface of a body of the musical instrument.

An embodiment of the invention relates to a musical instrument, the instrument includes a novel construction and arrangement of parts hereinafter fully described, whereby the tone of the instrument allows a user to play one or more notes within range of over an octave per string, improving performance, rigidity and strength of related art instruments. The instrument also does not include a fretboard. As used herein, a fretboard is a fingerboard on a guitar or other musical instrument that allows a user to alter the frequency of the pitch. When a string is pressed against the fret, the vibrating portion of the string is shortened, allowing the user to change the frequency of the pitch, and thus the note. Typically, the distance between a fretboard and the string is about a 0.3 inch or less.

An octave as used herein means the interval between two sounds having a frequency ratio of two. There are eight octaves on the keyboard of a standard piano. Stated another way, an octave means a series of eight notes occupying the interval between (and including) two notes, one having twice or half the frequency of vibration of the other.

In one embodiment, the musical instrument can have a body in a variety of sizes or shapes. The instrument includes one or more strings where the strings are stretched across the length of the body of the instrument. These strings are fed through a stop block unit. The stop block unit is configured to stabilize the placement of each of the one or more strings. In a preferred embodiment, the stop block unit includes one or more rollers or wheels with a channel, e.g., a mechanism, that can rotate with a ball bearing in an axis of the roller that allows it to rotate freely from a first position to a second position. The channel region is configured to receive at least a portion of each of the strings. The channel region is dimensioned to be greater the diameter of the string. This allows for tension to be added to one side of the string, thus pulling the other side tighter, thereby shifting the frequency of the pitch vibrations. The ball bearing mechanism allows the string to pull tight to one side, and then release to the same relative position as before with minimal friction or reduced friction as compared to not having a ball bearing.

After each of the strings are tuned, e.g., tensioned to predetermined tensions, that would produce a desired tone or note when plucked, a set tuning may be applied. On the upper side of the rollers, the strings stretch across a neck of instrument configured and dimensioned to allow a user to hold in one hand and attach to a tuning peg. There is a space or distance between the board of the string to an upper surface of the neck. In one embodiment, the space may be about 0.5 inch to about 3 inches or greater at standard tension, and pulled to within about 0.1 inch away from the upper surface or touching of the neck, i.e., in direct contact with neck, or greater. In this embodiment, the string does not touch the neck, thereby in operation the string is not shortened to achieve a note or tune as done with related art instruments using fretboard or fingerboard. Optionally and/or alternatively, the string can touch the neck without effecting the pitch of the plucked portion of the string.

In one embodiment, the space between the string and neck is large enough to pull the strings into the space to allow the instrument to play any range of notes that may reach one or more notes within range of over an octave per string. Pulling the string into the space provides a desired amount of tension on the string, increasing this tension, also increases the tension on the opposite side of the rollers, raising the pitch frequency from the vibrations of the strings on the lower end of the rollers when plucked or struck. Optionally, an electric pickup can be placed under the strings at the lower end of each of the strings, thus picking up the vibrations on the plucked side of the string. Any electric pickup as known in the art can be utilized.

In one embodiment, an aspect of the invention allows a user to play each string and that each string is capable of playing entire scales or melodies within the range or an octave, per each individual string. The instrument is also capable of being played on a lap of person, standing up with a person, e.g., similar to how a guitar may be played. Thereby allowing a user to play along with modern bands, and the option of portability. That is, one embodiment is directed towards a portable instrument that can be carried in a case and transported that way.

In one embodiment, the instrument has the following dimensions: a length in range from about 12 inches to about 40 inches or greater, a width from about 2 inches to about 14 inches or greater, and a thickness from about 0.5 inches to about 3 inches or greater. In one embodiment, the instrument is portable and meant to be carried and played by a user similar to a conventional guitar.

One embodiment, is directed towards an instrument that allows a user to play an instrument without learning mathematics of a keyboard, note arrangement positions of a fretboard, using a fretboard, but allows a user to simply place their hand in one stationary place on a string. In addition, the user can use their ear and/or muscle memory to find the pitches they wish to achieve. This instrument allows for playing in a much more intuitive way as compared to other conventional instruments. Accordingly, it is believed, the learning curve to learn how to play this instrument is much faster than learning other traditional musical instruments. Moreover, the instrument can be used by people with disabilities, e.g., a user with impaired vision can easily learn to manipulate this instrument, without having to see, i.e., only by ear and feel.

In one embodiment, the body of the instrument can be built using common woodworking methods when using wood as the material. It can be cut from rough lumber by a band saw, or a CNC machine, with electronic cavity cut with a common wood router. The roller blocks can be made with a table saw, drill, and band saw. All parts can be finished with various sanding tools, and any commercially available clearcoat method can be applied for protection of the finished product. The string anchor on the bottom end of the strings can be commercially available products, or a simple plate with holes to anchor the string through, and a raised "saddle" piece to raise the string vibration contact point to an appropriate height. This height should allow the string to clear the pickups and body by a distance that keeps each of the strings from touching while being plucked, but low enough to interact with the magnetic field of magnetic pickups, if used.

One embodiment is directed towards a method of making a musical instrument. The method includes providing a desired material or materials for the instrument, e.g., wood. When using wood material, a common thickness is about 2 inches thick for the neck and body, other wood or alternative materials such as plastics or other thermoplastics for cavity, nut and bridges or other pieces of the instrument can also be used. Next, the wood is formed into a desired dimension, e.g., cut wood into desired dimensions. Next, one can plane sides of neck for body wings and peghead ears and inside body wings. Next, one can trace and rough-cut body wings on band saw, e.g., with a two-pattern method. Next, one can glue up body wings to sides of neck piece and optionally use nails to prevent sliding. Next one can glue up peghead ears and clean up excess wood with grinder or other, to prepare for sanding, e.g., with a feed sander or similar sander. When using a feed sander, one runs both the sides through feed sander and levels back of headstock. Next, the instrument pieces are applied to an instrument template to blank and one can use screws where cavities and headstock tuner or nut will be and cut excess wood with handsaw. The entire pattern can then be routed with a router and route body and neck (not headstock) with round bit, e.g., 0.25 inch. Next, the instrument is shaped as necessary with grinder and sanders. Next, one can drill holes for tuning machines and drill holes for headstock nut, cavity cover, roller bridges, and string tailblock.

Optionally and/or alternatively, an inlay logo or other logo can be added. Finally, an instrument is sanded, and the outside treated with a protective coating, e.g., oil (once a day for 10 days more or less), clearcoat, varnish, combinations of the same and like. Next, one can cut and assemble roller bridge pieces and cut and bevel pickguards, route for pickups, and drill holes for controls and jack and add a protective coating as described herein. Next, one can cut and shape string nut and install optional electronics and hardware, bridges, string tail block (and string ground to it), nut, tuners, strings.

Reference will now be made in detail to an embodiment of the present invention, example of which is illustrated in the accompanying drawings.

Figure 2:
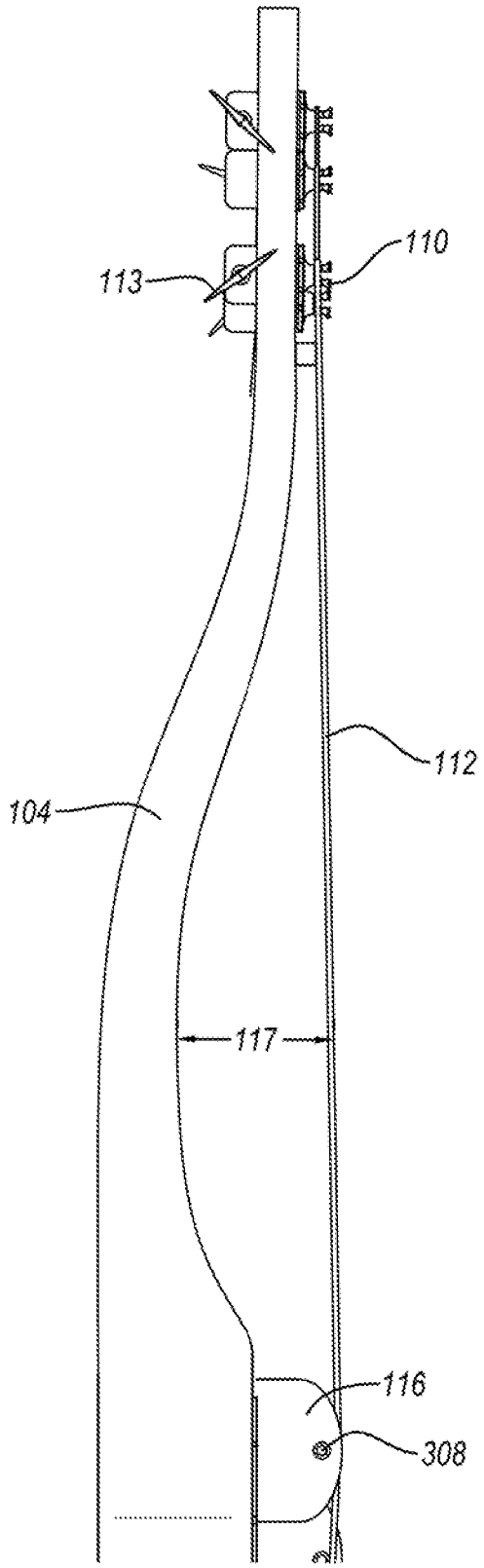
FIG. 2 illustrates an exemplary partial side view of the musical instrument of FIG. 1 according to an embodiment of the invention.
Figure 3:
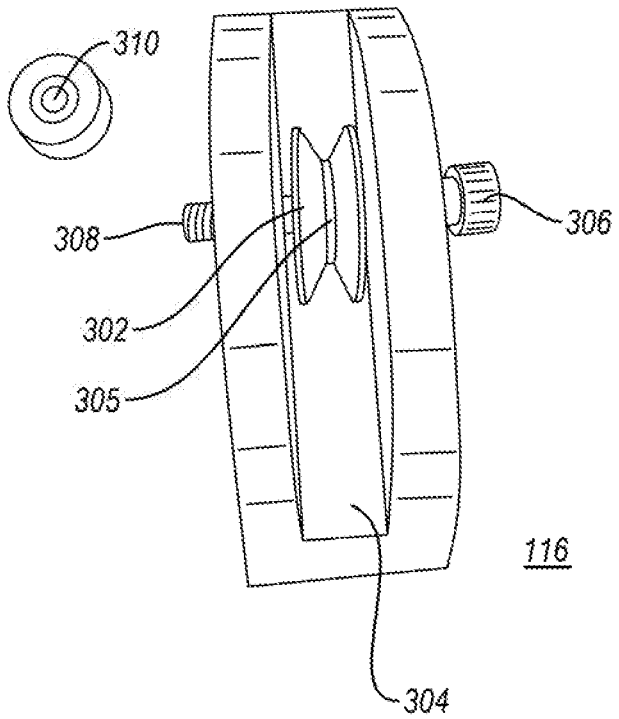
FIG. 3 illustrates an exemplary view of the stop block unit of the musical instrument of FIG. 1 according to an embodiment of the invention.

FIG. 1 illustrates an exemplary view of a musical instrument according to an embodiment of the invention. FIG. 2 illustrates an exemplary view of the musical instrument of FIG. 1 according to an embodiment of the invention. FIG. 3 illustrates an exemplary view of the stop block unit of the musical instrument of FIG. 1 according to an embodiment of the invention.

Referring to FIGS. 1-3, the musical instrument is generally depicted as reference 100. The instrument 100 includes a body 102 having a top 106, a bottom 108, a first side 109, an opposite second side 111 and a thickness (not shown) between the first side 109 and the second side 111. As shown herein the neck has a first end, a second end, a first side and an opposite a second side, wherein the neck does not comprise a fingerboard, a fret or a fret region.

The instrument includes a neck 104 and a head 111 either configured integral with the neck 104 as a single unit piece of material or coupled to the neck 104. The head 111 includes one or more tuning pegs 110 and a nut 114 is configured to receive one or more guitar strings 112. The nut 114 has a concave shape (not shown). Each of the one or more guitar strings 112 has a first end and second opposite end. The first end of each guitar string 112 is configured to be attached to the one more tuning pegs 110 and be tensioned with a mechanical turning peg 113. The body 102 includes a bridge assembly 115 releasably coupled to a bottom portion of the body configured to receive the second end of each guitar string 112. In this embodiment, the bridge assembly is an individual assembly for each string 112. Optionally one or more electrical pickups 103 are coupled to a portion of the body 102. Electrical pickups are known in the art and also described herein.

The instrument 100 includes one or more stop block units 116 releasably coupled to the body 102 between the bridge assembly 115 and the head 111. The one or more stop block units 116 includes a channel region 304 configured to receive a rotational unit 302 having a channel region 305 and a ball bearing 310 to permit easy rotation. The rotational unit 302 is coupled to the stop block unit 116 includes a bolt, screw, or the like 306 and optional nut 308 on an end of the bolt, screw, or the like 306 to couple the rotational unit 302 to the stop block unit 116 in the channel 304. The channel region 305 of the rotational unit 116 is configured to receive at least a portion of each guitar string 112.

Optionally and/or alternatively, there is no ball bearing 310 the rotational unit 302 may or may not rotate. In such a case the rotational unit can include an anti-frictional material or coating prevent or reduce friction, thereby allowing the strings to move from a first location to a second location, e.g., expanded PTFE (ePTFE), ceramic, or the like. Optionally and/or alternatively, the rotational unit does not include a channel 305, but is flat to allow the string to move with the anti-frictional material. Moreover, the rotation unit 302 with the ball bearing 310 can also include no channel and/or an anti-frictional material, coating or combination of the same.

In this embodiment, each guitar string 112 is stretched between the bridge assembly 115 to the tuning peg 110 and over the rotational unit 116 such that portion of the guitar string 112 can move from a first position to a second position on application of force and there is a distance 117 between each guitar string 112 a side of the neck 104 to allow a user to tension each string play up to one or more notes within range of over an octave per string.

Figure 4:
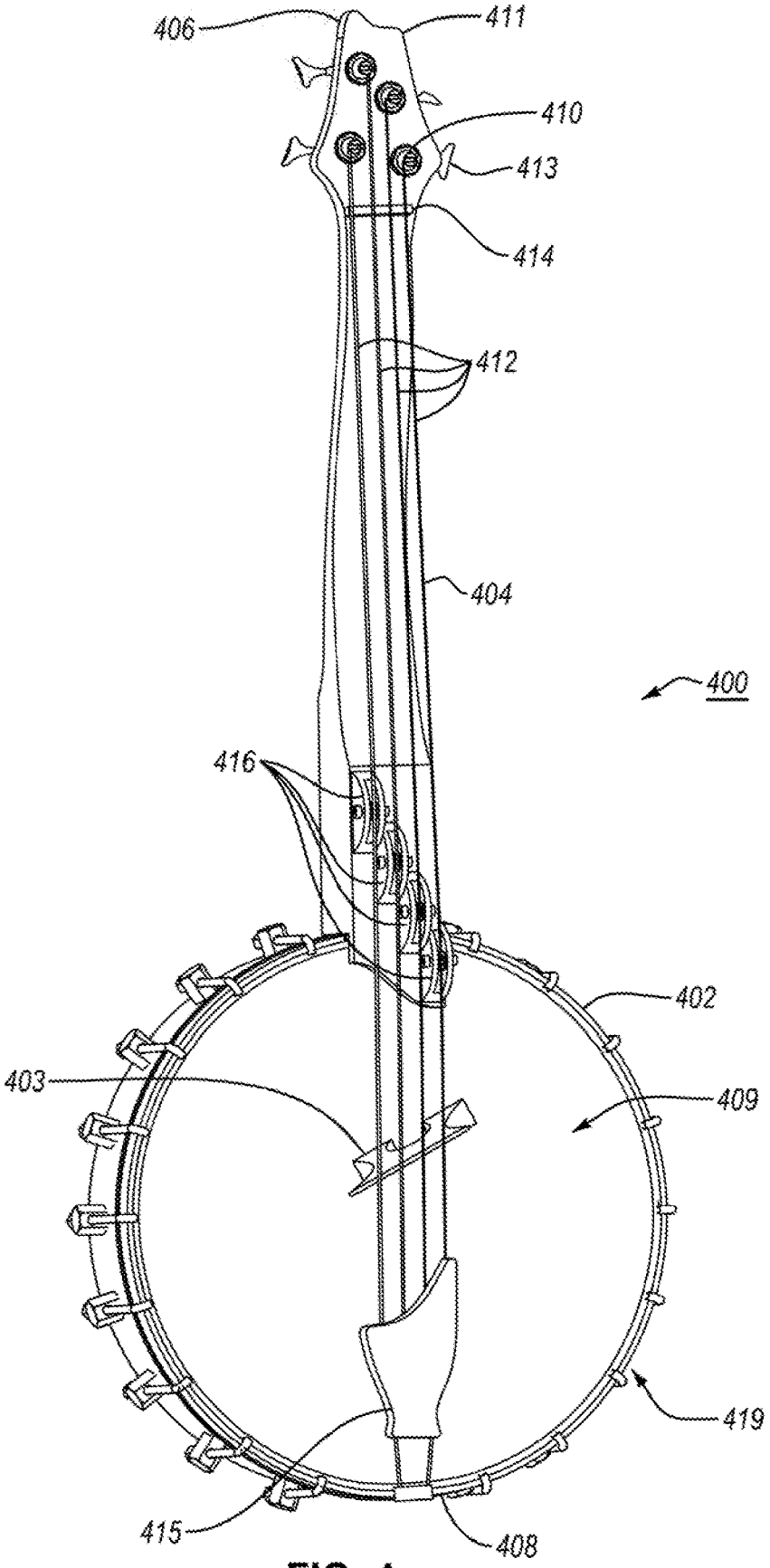
FIG. 4 illustrates an exemplary view of a musical instrument according to an embodiment of the invention.
Figure 5:
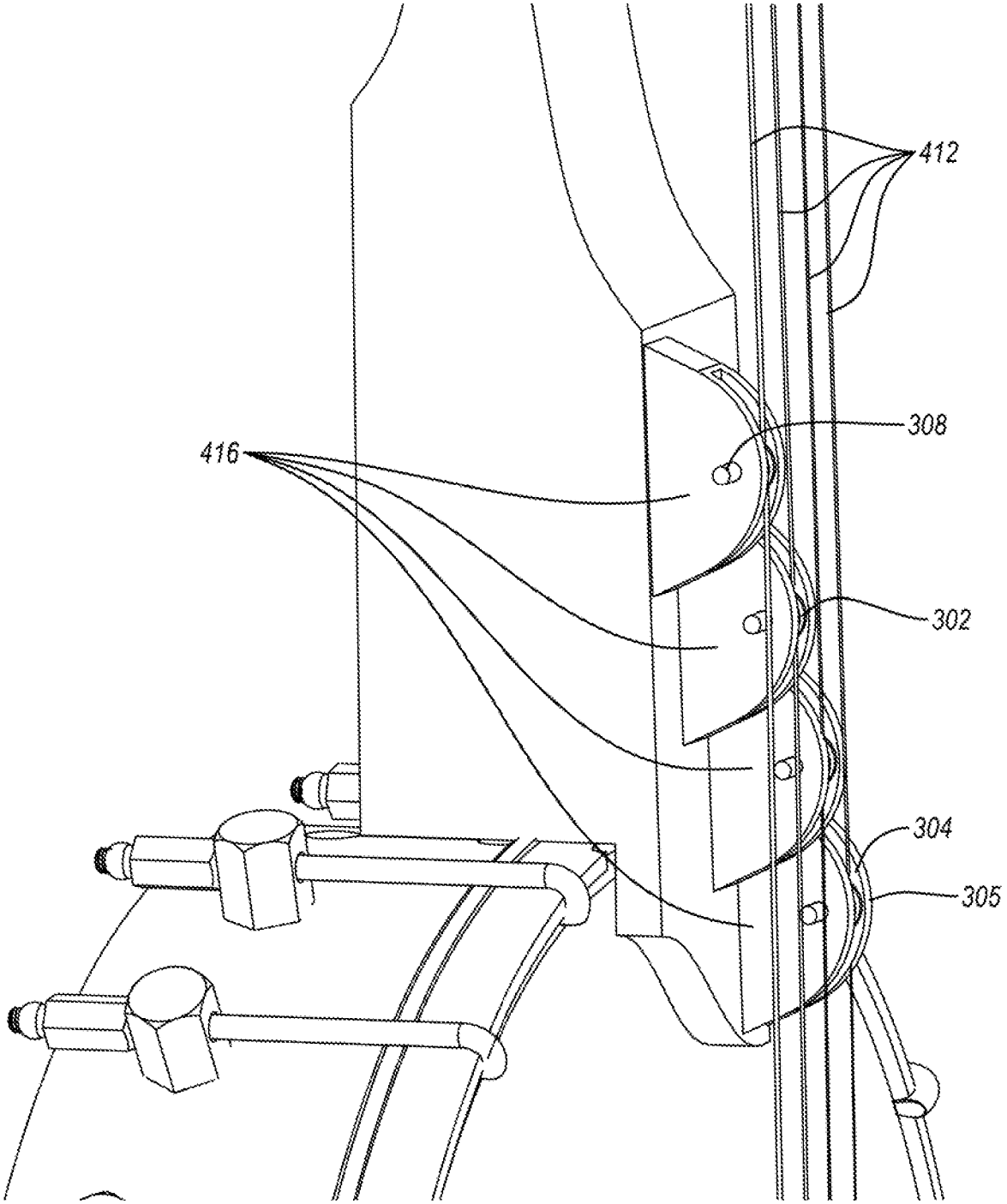
FIG. 5 illustrates an exemplary partial magnetified side view of the musical instrument of FIG. 4 according to an embodiment of the invention.
Figure 6:
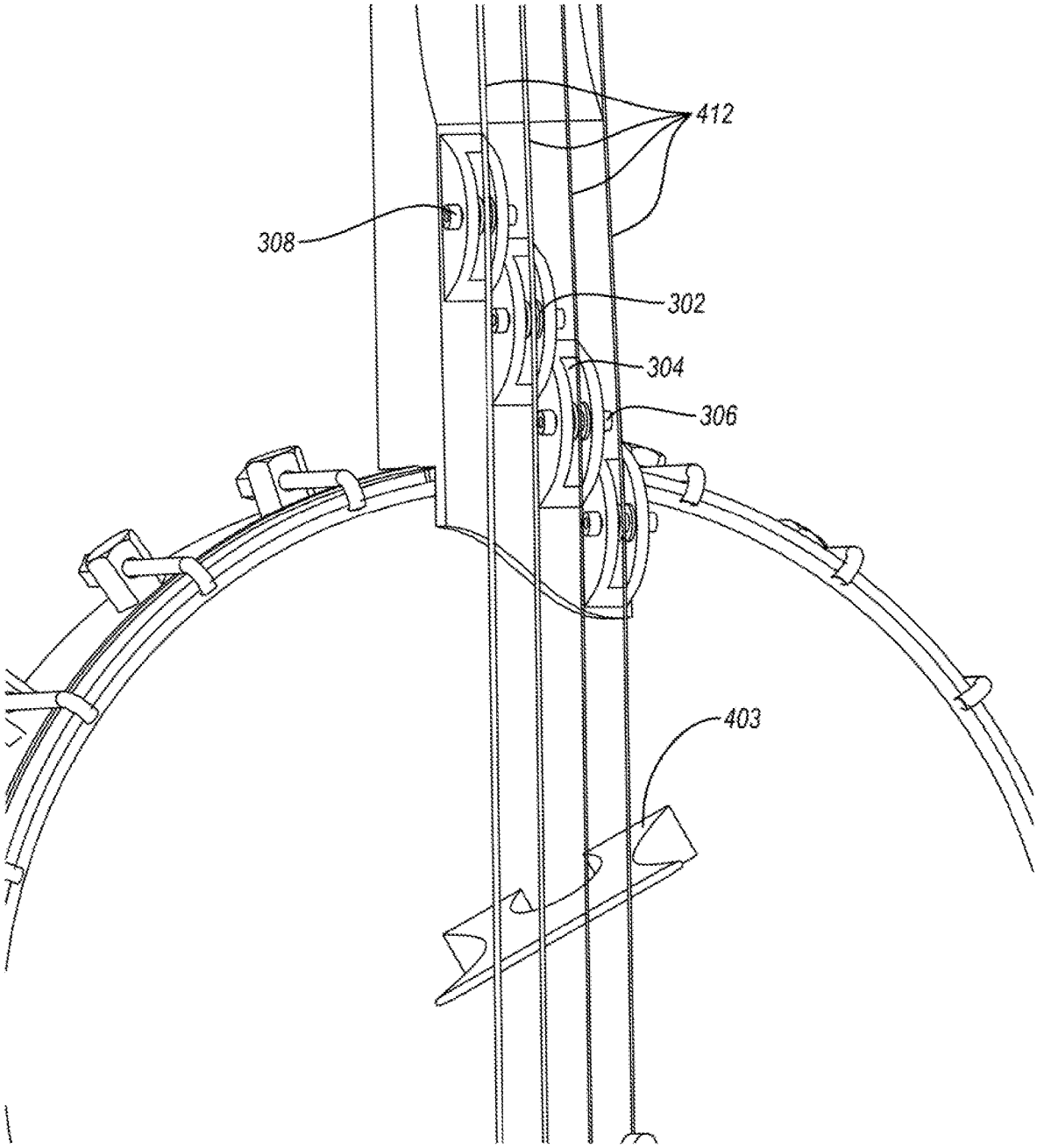
FIG. 6 illustrates an exemplary partial magnetified side view of the musical instrument of FIG. 4 according to an embodiment of the invention.

FIG. 4 illustrates an exemplary view of a musical instrument according to an embodiment of the invention. FIG. 5 illustrates an exemplary partial magnetified side view of the musical instrument of FIG. 4 according to an embodiment of the invention. FIG. 6 illustrates an exemplary partial magnetified side view of the musical instrument of FIG. 4 according to an embodiment of the invention.

Referring to FIGS. 4-6, the musical instrument is generally depicted as reference 400. The instrument 400 includes a body 402 having a top 406, a bottom 408, a first side 409, an opposite second side 419 and a thickness (not shown) between the first side and the second side. A neck 404 having a first end, a second end, a first side and an opposite a second side, wherein the neck does not comprise a fingerboard, a fret or a fret region. A saddle 403 is configured in an angled configuration the angle being in a range from about 10 degrees to about 60 degrees. Combined with the string tension, the angle or its degree determines the open note of each of the strings.

The instrument includes a neck 404 and a head 411 either configured integral with the neck as a single unit piece of material or coupled to the neck 406. The head 411 includes one or more tuning pegs 410 and a nut 414 configured to receive one or more guitar strings 412 each guitar string 412 has a first end and second opposite end. The first end of each guitar string 412 is configured to be attached to the one more tuning pegs 410 and be tensioned with a mechanical turning peg 413. The body 402 includes a tailpiece assembly 415 releasably coupled to a bottom portion of the body configured to receive the second end of each guitar string 412. Optionally one or more electrical pickups (not shown) are coupled to a portion of the body 402. Electrical pickups are known in the art and also described herein.

The instrument 400 includes one or more stop block units 416 releasably coupled to the body 402 between the tailpiece assembly 415 and the head 404. The one or more stop block units 416 is described herein with reference to FIG. 3. Moreover, each guitar string 412 is stretched between the tailpiece assembly 415 to the tuning peg 410 and over the rotational unit 302 such that portion of the guitar string 412 can move from a first position to a second position on application of force and there is a distance 706 between each guitar string 412 and side of the neck 404 to allow a user to tension each string to play to play one or more notes within range of over an octave per string.

Referring to FIG. 5, the instrument 400 includes one or more stop block units 416 releasably or permanently coupled to the body 404 between the tailpiece assembly 415 and the head 411. The one or more stop block units 416 includes a channel region 304 configured to receive a rotational unit 302 having a channel region 305 and a ball bearing (not shown) to permit easy rotation. The rotational unit 302 is coupled to the stop block unit 416 with a bolt 306 and optional nut 308 on an end of the bolt 306. The channel region 302 of the rotational unit 302 is configured to receive at least a portion of each guitar string 412. In this embodiment, the channel region is dimensioned greater than the diameter of each string 412.

Moreover, each guitar string 412 is stretched between the tailpiece assembly 415 to the tuning peg 410 and through the channel region 302 of the rotational unit 302 such that portion of the guitar string 412 can move from a first position to a second position on application of force and there is a variable distance 706, 708, 710, 712, and 714 between each guitar string 412 a side of the neck 404 based on a tension of each string by the user that allows a user to play up to one or more full octaves on each string.

Figure 7A:
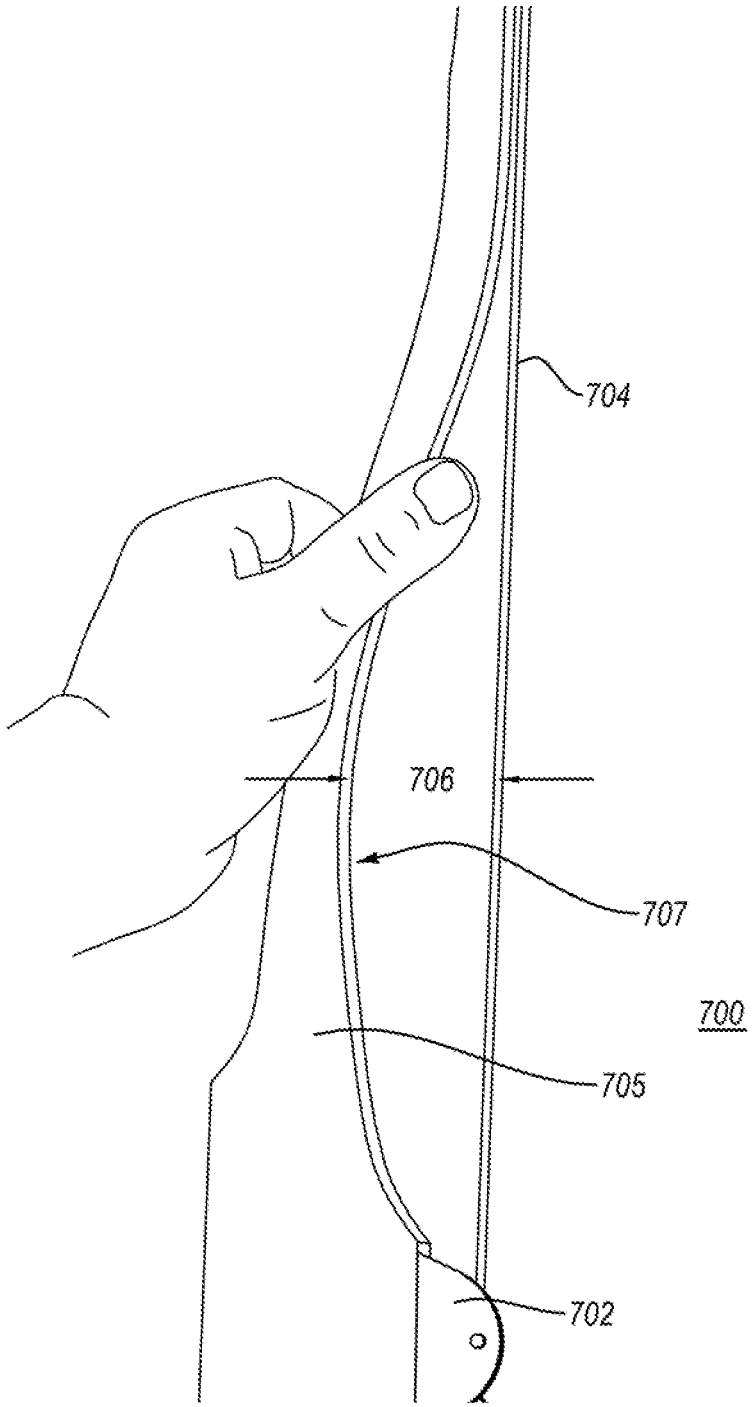
FIG. 7A illustrates a partial side view of an instrument according to an embodiment of the invention with one or more strings in a first orientation.
Figure 7B:
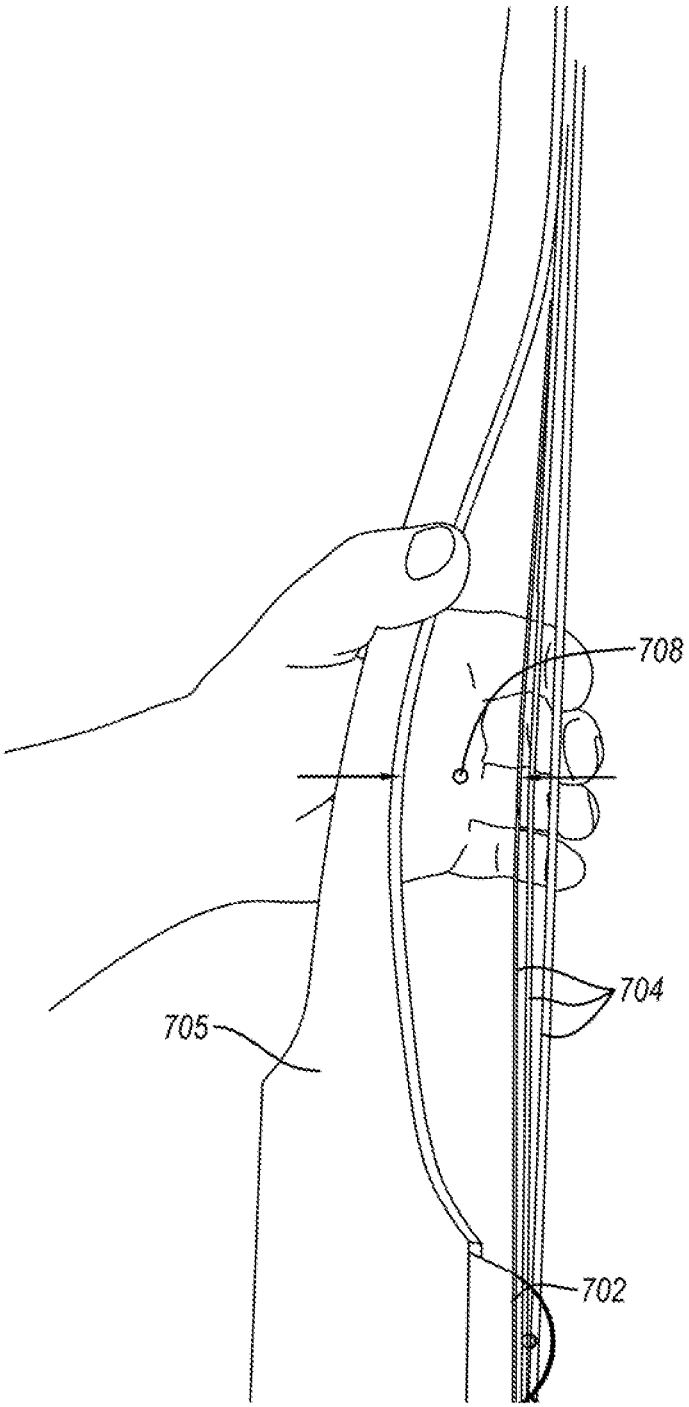
FIG. 7B illustrates a partial side view of an instrument according to an embodiment of the invention with one or more strings in a second orientation.
Figure 7C:
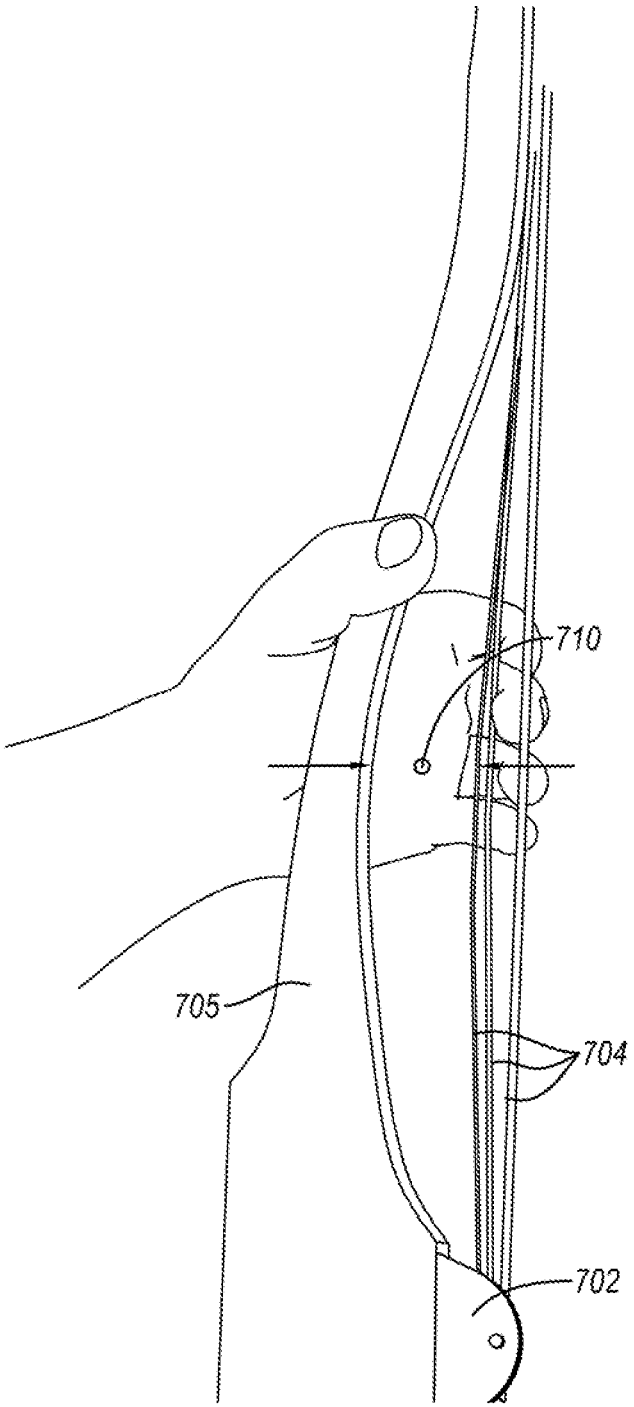
FIG. 7C illustrates a partial side view of an instrument according to an embodiment of the invention with one or more strings in a third orientation.
Figure 7D:
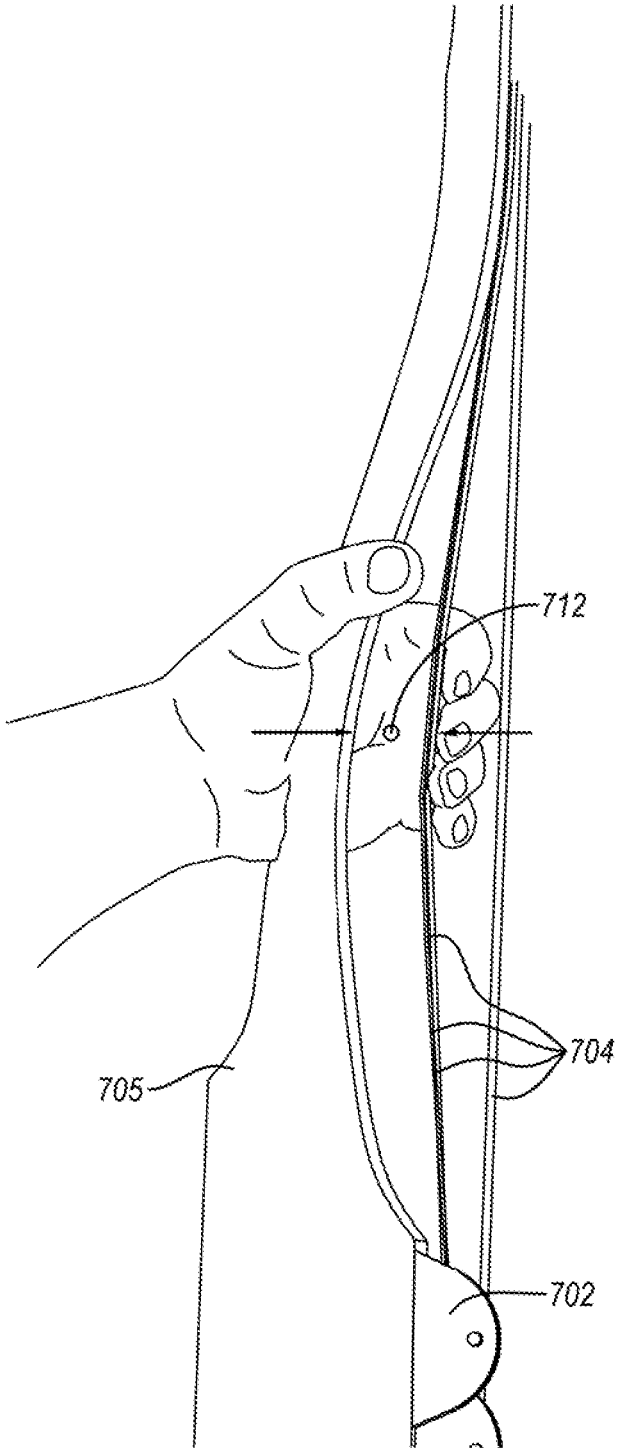
FIG. 7D illustrates a partial side view of an instrument according to an embodiment of the invention with one or more strings in a fourth orientation.
Figure 7E:
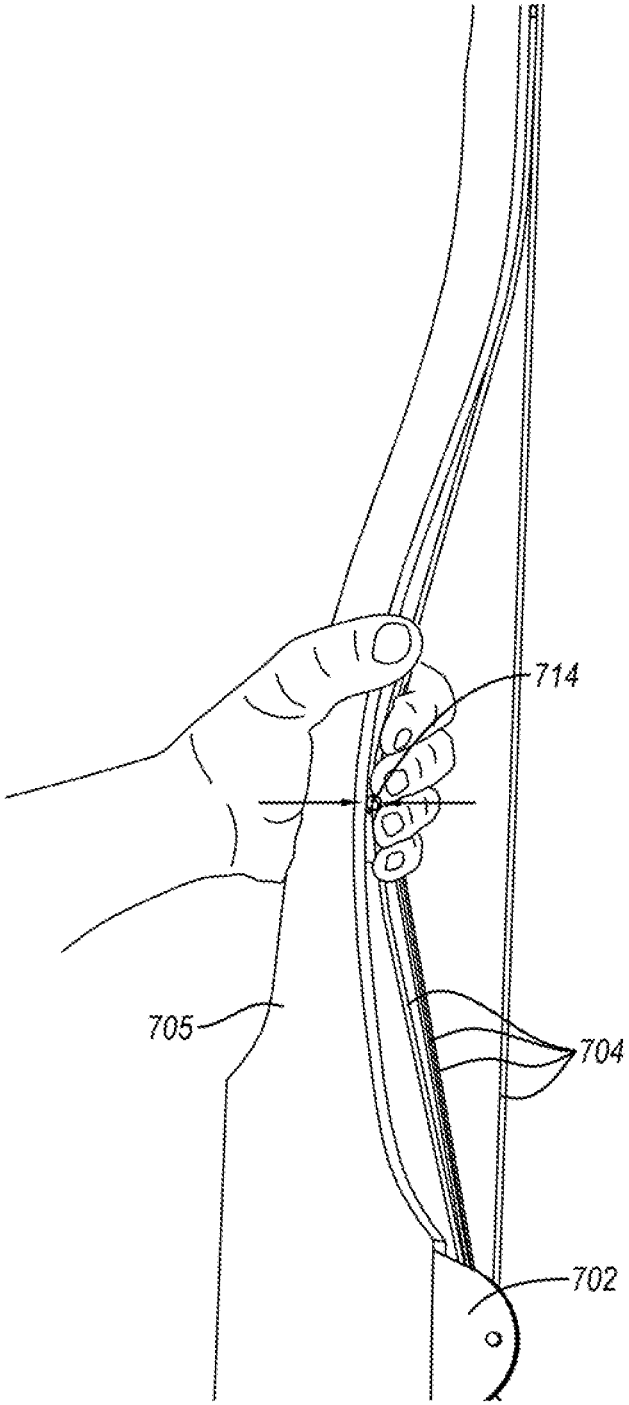
FIG. 7E illustrates a partial side view of an instrument according to an embodiment of the invention with one or more strings in a fifth orientation.

FIG. 7A illustrates a partial side view of an instrument according to an embodiment of the invention with one or more strings in a first orientation. FIG. 7B illustrates a partial side view of an instrument according to an embodiment of the invention with one or more strings in a second orientation. FIG. 7C illustrates a partial side view of an instrument according to an embodiment of the invention with one or more strings in a third orientation. FIG. 7D illustrates a partial side view of an instrument according to an embodiment of the invention with one or more strings in a fourth orientation. FIG. 7E illustrates a partial side view of an instrument according to an embodiment of the invention with one or more strings in a fifth orientation.

Referring to FIGS. 7A-7E, the musical instrument 700 can be any musical instrument described herein. The instrument 700 includes one or more stop block units 702 as described herein. The channel region of the stop block units 702 is configured to receive at least a portion of each string 704.

The distance between each of the one or more strings 704 and a surface of the neck 705 is variable and adjustable by the use or tension of one or more strings 704 by the user. The distance can be in a range from about 0.1 inches to about 2.5 inches or greater. Each of the strings does not have to touch the neck, but may touch the neck in which case the distance is 0 inches.

In FIG. 7A, the distance 706 is about 1.8 inches. In this configuration, The instrument will sound a note of the standard tuned pitch selected.

In FIG. 7B, the distance 708 is about 1.5 inches. In this configuration, the note played will be shifted up approximately one standard musical scale note.

In FIG. 7C, the distance 710 is about 1.2 inches. In this configuration, the note played will be shifted up approximately 4 standard musical scale notes.

In FIG. 7D, the distance 712 is about 0.8 inches. In this configuration, the note played will be shifted up approximately one full octave on a standard musical scale.

In FIG. 7E, the distance 714 is about 0.2 inches. In this configuration, the note played will be shifted up approximately one full octave and three additional notes on a standard musical scale.

Figure 8:
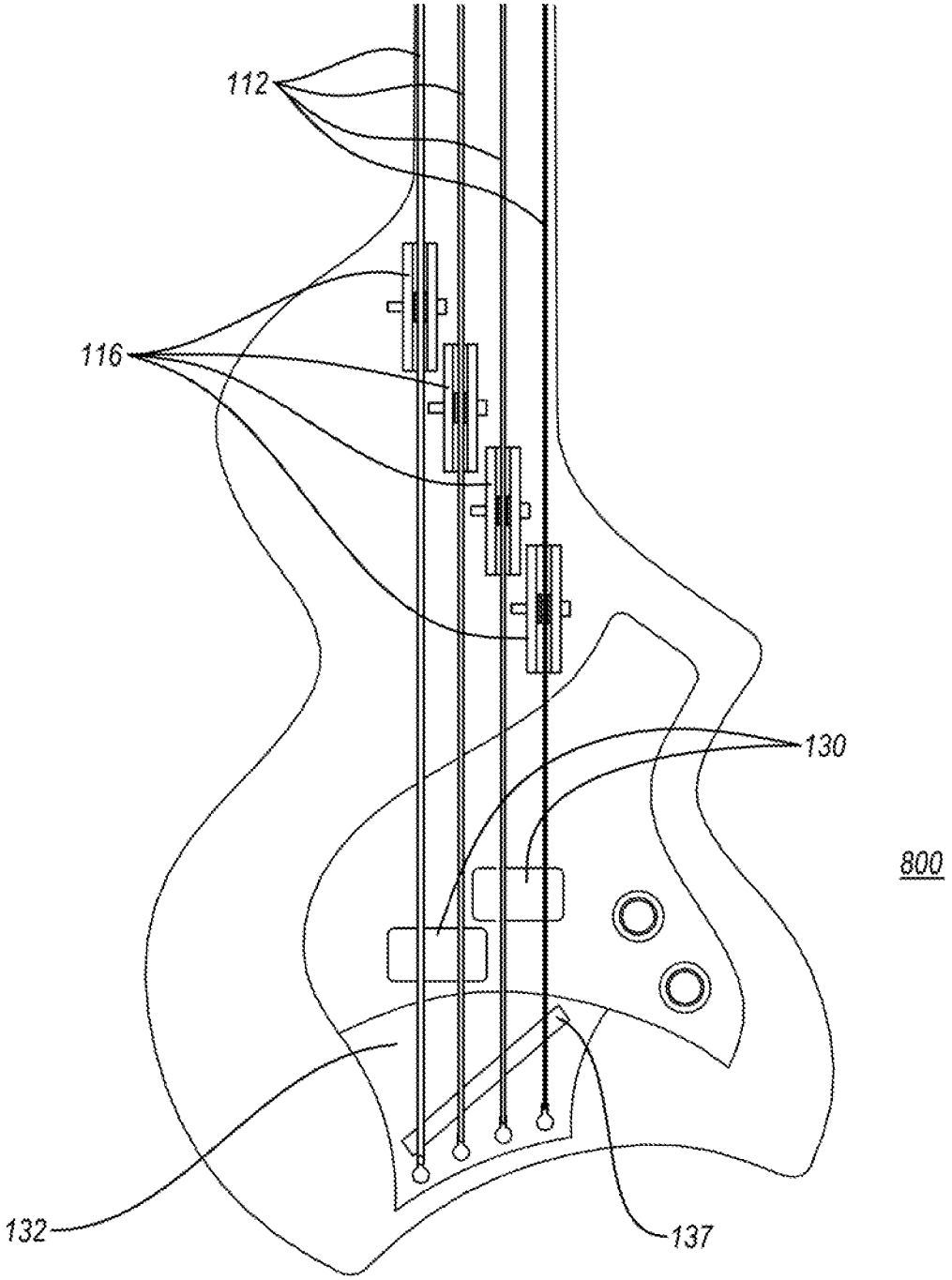
FIG. 8 illustrates an exemplary view of a musical instrument according to an embodiment of the invention.
Figure 9:
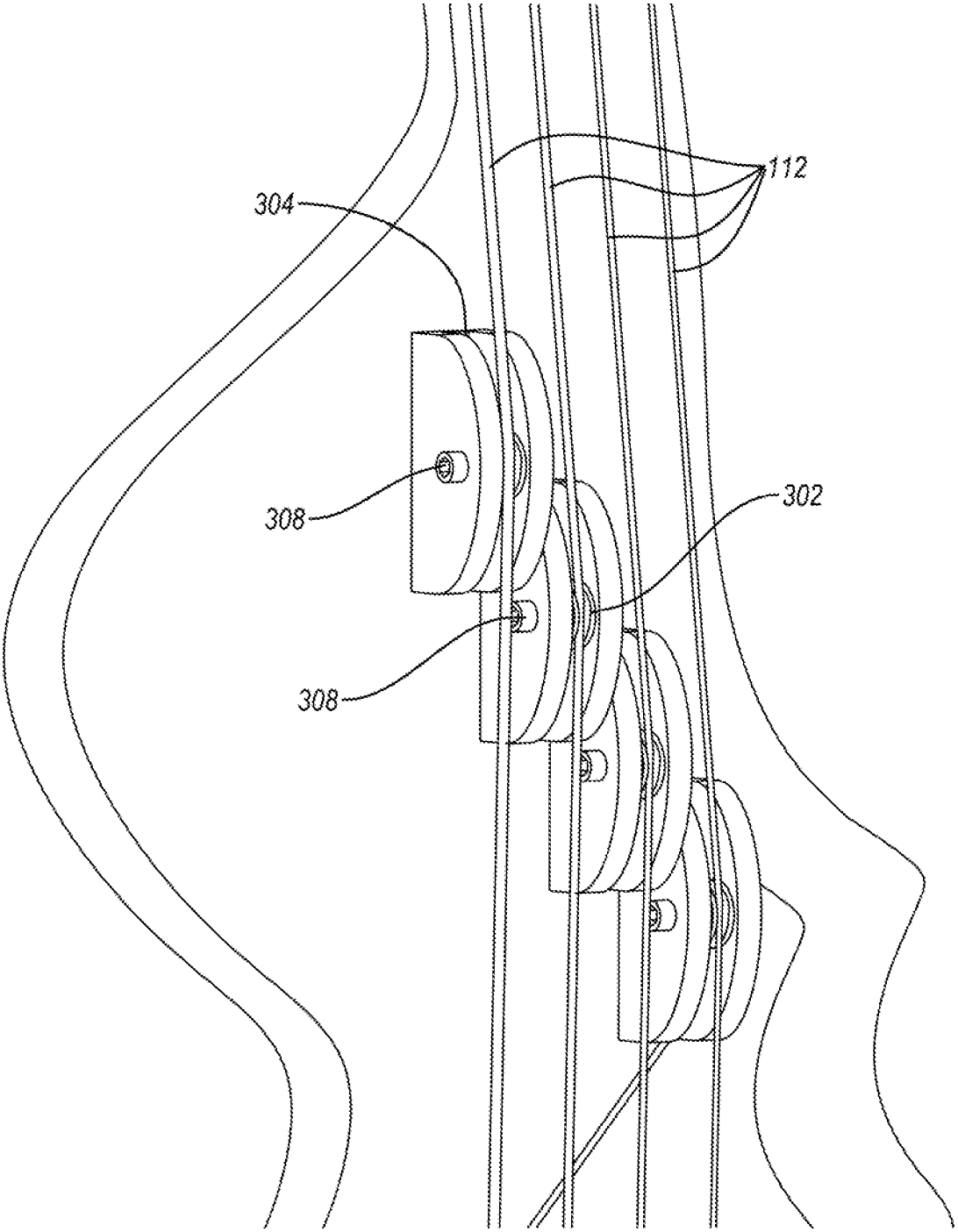
FIG. 9 illustrates an exemplary partial magnified front view of the musical instrument of FIG. 8 according to an embodiment of the invention.
Figure 10:
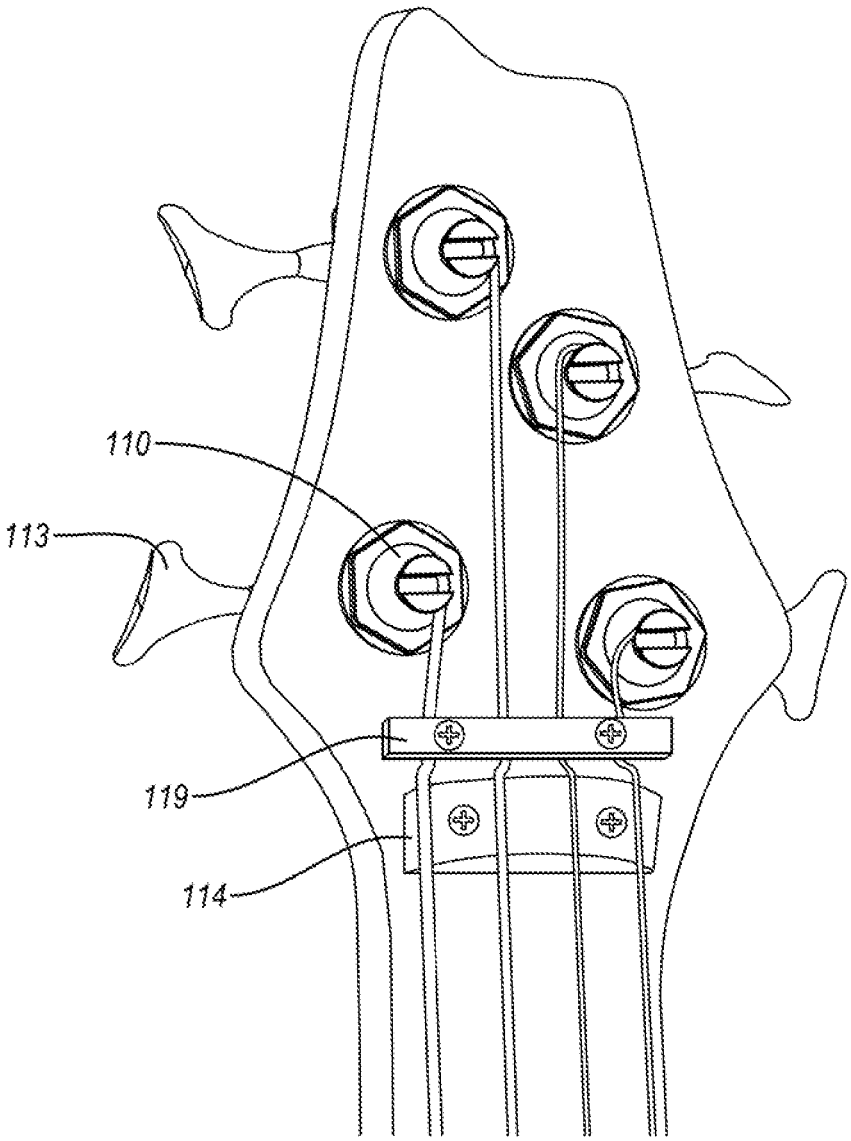
FIG. 10 illustrates an exemplary partial magnified front view of the musical instrument of FIG. 8 according to an embodiment of the invention.
Figure 11:
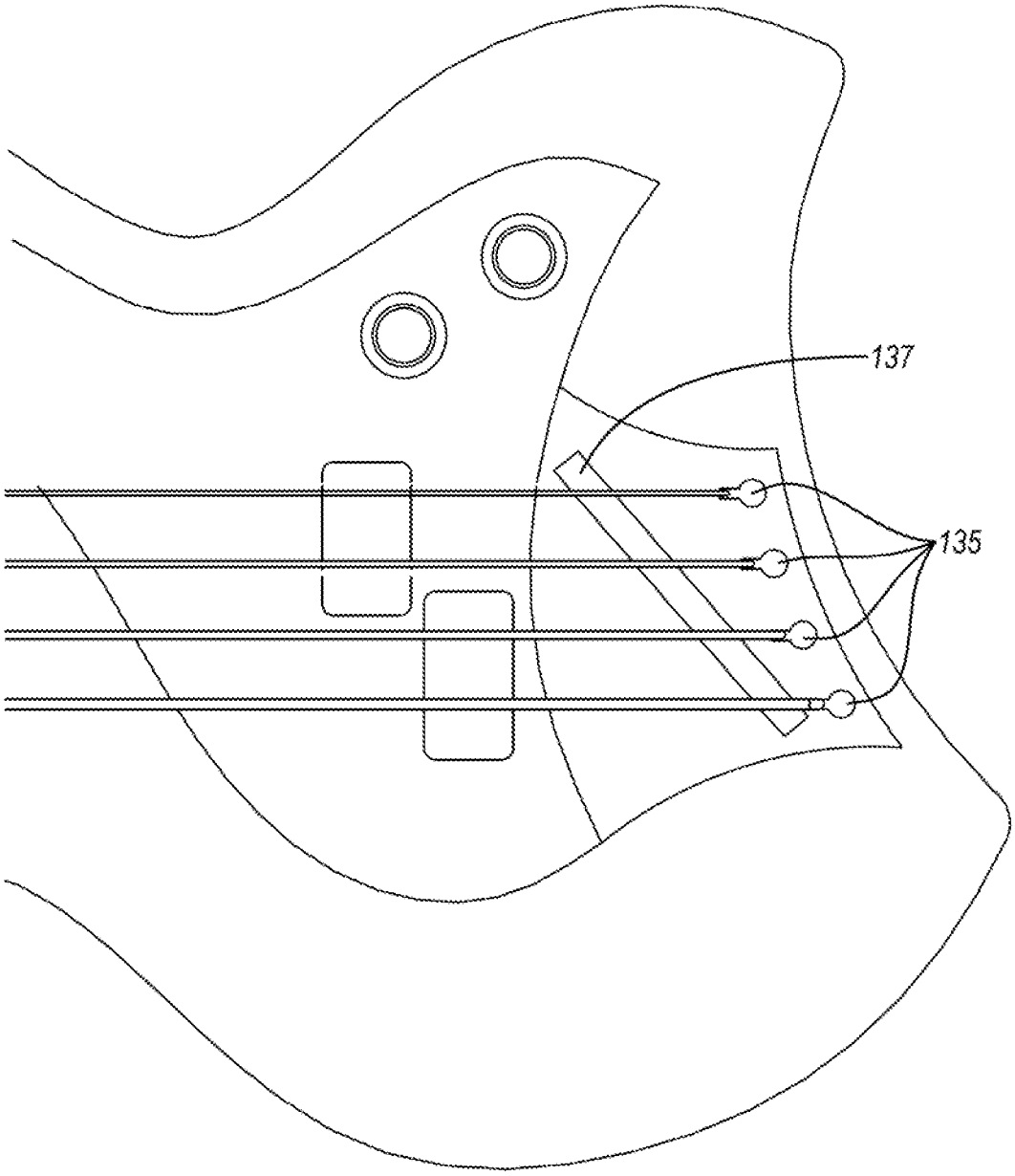
FIG. 11 illustrates an exemplary partial magnified front view of the musical instrument of FIG. 8 according to an embodiment of the invention.

FIG. 8 illustrates an exemplary view of a musical instrument according to an embodiment of the invention. FIG. 9 illustrates an exemplary partial magnified front view of the musical instrument of FIG. 8 according to an embodiment of the invention. FIG. 10 illustrates an exemplary partial magnified front view of the musical instrument of FIG. 8 according to an embodiment of the invention. FIG. 11 illustrates an exemplary partial magnified front view of the musical instrument of FIG. 8 according to an embodiment of the invention.

Referring to FIGS. 8-11, the musical instrument 100 is described generally with reference to FIGS. 1-2. In this embodiment, the musical instrument includes a machined bridge plate 132 with raised region 137 also machined. The machined bridge plate 132 includes a single unitary piece. Optionally, a secondary secure piece 119 is utilized with the nut 114 to further aid in securing and tensioning of each string.

One or more electrical pickups 130 are also provided. The electrical pickups 130 are known in the art and also described herein.

The one or more stop block units 116 includes a channel region 304 configured to receive a rotational unit 302 having a channel region 305 and a ball bearing 310 to permit easy rotation. The rotational unit 302 is coupled to the stop block unit 116 includes a bolt 306 and nut 308 on an end of the screw (not shown) with a head and screw feature 308 to couple the rotational unit 302. The channel region 305 of the rotational unit 116 is configured to receive at least a portion of each guitar string 112

Moreover, each guitar string 112 is stretched between the bridge assembly 132 to the tuning peg 110 and over the rotational unit to tension the string and rotate the tuning peg 113. Between each guitar string 112 a side of the neck 104 allows a user to tension each string to play one or more notes within range of over an octave per string.

Referring to FIG. 11, one or more notches 135 are machined into a bridge assembly to receive a second end of each of the strings. The second end of each of the strings includes a stopping mechanism, e.g., plastic piece, metal, or knot, as known in the art to be releasably secured by the notch 135.

Figure 12:
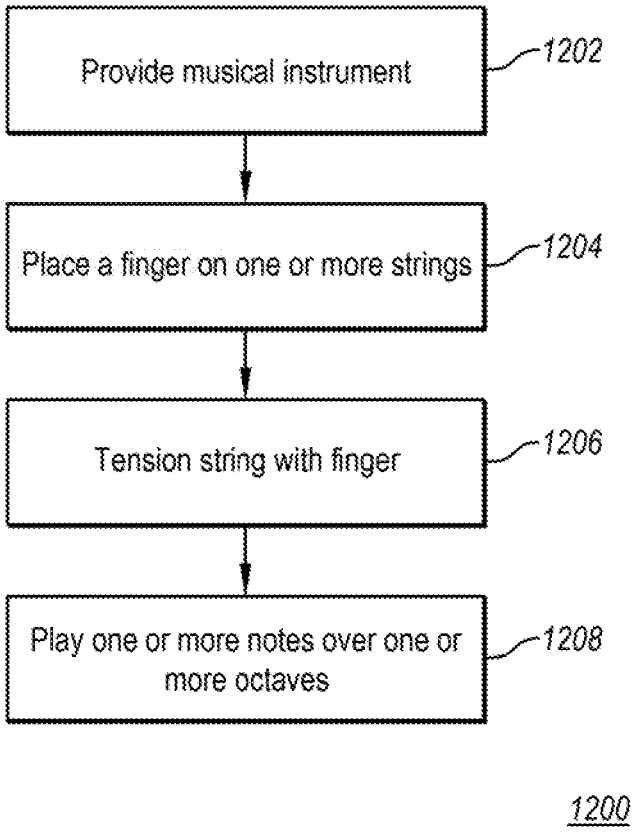
FIG. 12 illustrates a method of playing the musical instrument according to an embodiment of the invention.

FIG. 12 illustrates a method of playing the musical instrument according to an embodiment of the invention.

Referring to FIG. 12, the method is generally described with reference to number 1200. The method includes providing a musical instrument 1202, placing a finger on one or more strings 1204, tensioning the one or more strings 1206 to allow a user to play one or more notes within range of over an octave per string 1208.

Particular example implementations and embodiments of the subject matter have been described. As will be apparent to those skilled in the art, other implementations, alterations, and permutations of the particular implementations are considered to be within the scope of the disclosure and the following claims. Features of the various implementations are also combinable. While operations are depicted in the drawings or claims in a particular order, this should not be understood as requiring that such operations be performed in the particular order shown or in sequential order, or that all illustrated operations be performed (some operations may be considered optional), to achieve desirable results.

While this disclosure contains many specific implementation details, these should not be construed as limitations on the scope of any invention or on the scope of what may be claimed, but rather as descriptions of features that may be specific to particular implementations of particular inventions. Certain features that are described in the context of separate implementations can also be implemented, in combination, in a single implementation.

Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Accordingly, the previously described embodiments and implementations do not necessarily define or constrain this disclosure. Other changes, substitutions, and alterations are also possible within the scope of this disclosure.

To avoid unnecessarily obscuring the present disclosure, the preceding description may omit a number of known structures and devices. This omission is not to be construed as a limitation of the scopes of the claims. Specific details are set forth to provide an understanding of the present disclosure. It should however be appreciated that the present disclosure may be practiced in a variety of ways beyond the specific detail set forth herein.

Also, while the flowcharts have been discussed and illustrated in relation to a particular sequence of events, it should be appreciated that changes, additions, and omissions to this sequence can occur without materially affecting the operation of the disclosed embodiments, configuration, and aspects. A number of variations and modifications of the disclosure can be used. It would be possible to provide for some features of the disclosure without providing others.

Moreover, though the description has included a description of one or more aspects, implementations, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The inventions and methods described herein can be viewed as a whole, or as a number of separate inventions, that can be used independently or mixed and matched as desired. All inventions, steps, processes, devices, and methods described herein can be mixed and matched as desired. All previously described features, functions, or inventions described herein or by reference may be mixed and matched as desired.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A musical instrument, comprising:

a body having a top, a bottom, a first side, an opposite second side and a thickness between the first side and the second side;

a neck having a neck first end, a neck second end, a neck first side and an opposite neck second side, wherein the neck does not comprise a fingerboard, a fret or a fret region, wherein the neck first end comprises a head either configured integral with the neck as a single unitary piece of material or coupled to the neck first end, wherein the head comprises one or more tuning pegs configured to receive one or more guitar strings;

one or more guitar strings where each guitar string has a first end and second opposite end, wherein the first end of each guitar string is configured to be attached to the one more tuning pegs;

a bridge assembly releasably coupled to a bottom portion of the body configured to receive the second end of each of the one or more guitar strings;

one or more stop block units releasably coupled or non-releasably coupled to the body between the bridge assembly and the neck, wherein each of the one or more stop block units comprises a channel region configured to receive a rotational unit and the rotational unit comprises a channel region and a ball bearing unit to permit easy rotation, wherein the channel region of the rotational unit is configured to receive at least a portion of each guitar string of the one or more guitar strings, wherein each guitar string of the one or more guitar strings is stretched between the bridge assembly to the tuning peg and over the rotational unit such that a portion of the guitar string can move from a first position to a second position on application of force and there is a distance between each of the one or more guitar strings and the neck first side configured to allow a user to tension each string to play one or more notes within range of over an octave per string; and optionally one or more electrical pickups coupled to a portion of the body.

2. The instrument of claim 1, wherein the over octave per string is more than two octaves.

3. The instrument of claim 1, wherein the one or more guitar strings comprises one of: two strings, three strings, four strings, five strings, six strings, seven strings, eight strings, nine strings, ten strings, eleven strings, and twelve strings.

4. The instrument of claim 1, wherein the one or more guitar strings comprises at least two strings, wherein a first string has a first outside diameter and the second string has a second outside diameter, wherein the first outside diameter is greater than the second outside diameter.

5. The instrument of claim 1, wherein the body comprises wood.

6. The instrument of claim 1, wherein the body comprises one solid single unit piece of material.

7. The instrument of claim 1, wherein the body and the neck comprise one solid single piece of material.

8. The instrument of claim 1, wherein each of the one or more guitar strings comprises a string gauge in range from about 0.01 to about 0.15 or greater.

9. The instrument of claim 1, wherein the body comprises a hollow portion.

10. The instrument of claim 1, wherein the body comprises an inlay.

11. A method of playing a musical instrument, which comprises the steps of:

providing the musical instrument comprising a body having a top, a bottom, a first side, an opposite second side and a thickness between the first side and the second side; a neck having a neck first end, a neck second end, a neck first side and an opposite neck second side, wherein the neck does not comprise a fingerboard, a fret or a fret region, wherein the neck first end comprises a head either configured integral with the neck as a single unitary piece of material or coupled to the neck first end, wherein the head comprises one or more tuning pegs configured to receive one or more guitar strings; one or more guitar strings where each guitar string has a first end and second opposite end, wherein the first end of each guitar string is configured to be attached to the one more tuning pegs; a bridge assembly releasably coupled to a bottom portion of the body configured to receive the second end of each of the one or more guitar strings;

one or more stop block units releasably coupled or non-releasably coupled to the body between the bridge assembly and the neck, wherein each of the one or more stop block units comprises a channel region configured to receive a rotational unit and the rotational unit comprises a channel region and a ball bearing unit to permit easy rotation, wherein the channel region of the rotational unit is configured to receive at least a portion of each guitar string of the one or more guitar strings, wherein each guitar string of the one or more guitar strings is stretched between the bridge assembly to the tuning peg and over the rotational unit such that a portion of the guitar string can move from a first position to a second position on application of force and there is a distance between each of the one or more guitar strings and the neck first side configured to allow a user to tension each string to play one or more notes within range of over an octave per string; and placing a finger on one of the plurality of strings; and playing one or more notes within range of over an octave per string.

12. The method of claim 11, wherein the rotational unit comprises a material including one more of a plastic material, a metal material, a polymer material, and an alloy material.

13. The method of claim 11, wherein the rotational unit comprises a metal material.

14. The method of claim 11, wherein the one or more stop block units comprises a material including one more of a plastic material, a metal material, a polymer material, and an alloy material.

15. The method of claim 11, wherein musical instrument further comprises an electrical pick up.

* * * * *